United States Patent [19]

Lauper

[11] Patent Number: 4,670,947

[45] Date of Patent: Jun. 9, 1987

[54] HIDDEN CLASP FOR A BRACELET, PARTICULARLY FOR A WRIST-WATCH

[75] Inventor: Daniel Lauper, Givisiez, Switzerland

[73] Assignee: Interdica S.A., Villars-sur-Glane, Switzerland

[21] Appl. No.: 827,885

[22] Filed: Feb. 10, 1986

[30] Foreign Application Priority Data

Feb. 8, 1985 [FR] France ..... 85-01792

[51] Int. Cl.[4] ..... A44C 5/24

[52] U.S. Cl. ..... 24/71 J; 24/70 J; 24/265 WS

[58] Field of Search ..... 24/71 J, 70 J, 265 WS, 24/585, 629, 662, 682, 683

[56] References Cited

U.S. PATENT DOCUMENTS

| | | | |
|---|---|---|---|
| 1,778,313 | 10/1930 | Darling | 24/71 J |
| 1,966,063 | 7/1934 | Domler | 24/71 J |
| 3,083,430 | 4/1963 | Shears . | |
| 3,561,074 | 2/1971 | Mosher, Jr. et al. | 24/682 |
| 3,863,299 | 2/1975 | Hocq | 24/71 J |
| 3,916,756 | 11/1975 | Nifco . | |
| 3,929,265 | 12/1975 | Pyne et al. | 24/265 WS |

FOREIGN PATENT DOCUMENTS

| | | | |
|---|---|---|---|
| 157155 | 6/1954 | Australia | 24/71 J |
| 648830 | 3/1935 | Fed. Rep. of Germany . | |
| 627330 | 10/1927 | France | 24/71 J |
| 2259555 | 8/1975 | France . | |
| 2442605 | 8/1980 | France | 24/71 J |
| 1316472 | 5/1973 | United Kingdom . | |

*Primary Examiner*—Victor N. Sakran
*Attorney, Agent, or Firm*—Brisebois & Kruger

[57] ABSTRACT

A bracelet or wrist watch clasp which is completely hidden when closed. Studs having enlarged heads project from a central body which engages the wrist. Side legs are hinged to each end of a central body to swing to a closed position on the body. Each let has an annular radially elastic element retained in the thickness of its wall and positioned to receive and latch on a stud as the legs are swung to the closed position. Ends of the bracelet or watch band are connected to the free ends of the legs.

6 Claims, 6 Drawing Figures

HIDDEN CLASP FOR A BRACELET, PARTICULARLY FOR A WRIST-WATCH

The present invention relates to a clasp or snap fastener for a bracelet, especially for a wrist-watch, the clasp being of an invisible or hidden type, that is, in the closed position, the clasp is entirely hidden or covered by the bracelet, so that the bracelet appears to be continuous.

Clasps of this type are used for bracelets and bands constituted of transverse hinged links, or links arranged in longitudinal rows, the links of different rows usually being longitudinally offset relative to each other.

The clasp usually includes three hinged parts, namely a central body at each end of which is a hinged shorter side part or leg, each leg having a length less than half the length of the central body, so that the combined length of the legs is less than the length of the body. Each of the legs has means for fastening to a bracelet part or element, and each of the legs is able to be folded or pivoted back onto the outer face of the central body, and immobilized on the body by cooperating locking means provided on the body and each of the side legs.

The locking means generally comprise a cut out, or struck out portion in each side leg, the sides of which hook on, in a locking position, bent feet projecting from the outer face of the central body, and which latch together in the closed position. The feet are cut out of the side wall or flange of the central body.

Such clasps have a first disadvantage in that after a certain number of repeated cycles of opening and closing, wear occurs on the feet of the body and the edges of the corresponding cut out portions in the side legs so that the latch effect weakens relatively rapidly, which can result in unwanted and annoying opening of the clasp.

A second disadvantage with the traditional or conventional clasp described above is that the locking feet are cut out of struck out of the body of the clasp which when worn on the wrist, engage the wrist. The slot or slots of the cut out constitute capillary paths for movement of perspiration and a passageway for the entry of dirt and contaminants which then accumulate inside the clasp.

SUMMARY OF THE INVENTION

The present invention provides a clasp of the hidden or invisible type which eliminates the disadvantages mentioned above.

The clasp according to the invention is characterized by the fact that the locking means include, on the central body of the clasp, studs or projections, preferably of metal, projecting from the outer face of the central body, connected by their inners ends to the central body, and having an outer end or head of larger section, each of the studs or projections, being so positioned on the central body that, during the folding back or closing of the side legs of the clasp onto the central body, the studs are forced through a central opening of a radially elastic annular element lodged or seated within the thickness of the wall of each of the side legs.

In a first embodiment, each of the radially elastic elements is constituted of a non-metallic insert seated tightly, without play, in a corresponding opening or recess made in the thickness of the wall of each of the side legs. Each of the inserts has an annular groove or recess concentric with and outwardly of the central opening, this groove extending axially a portion of the height of the insert. The groove opens through that face of the insert which, after folding back or closing the corresponding side leg, faces toward the outer surface of central body.

Preferably, the central opening of the insert has an enlarged section corresponding to the enlarged section of the upper end of the stud or projection.

In a first form, the insert extends the entire thickness of the leg, and is lodged in an opening of corresponding shape made in the wall of the leg, and is held or retained in any appropriate manner, such as in particular, threading and/or bonding or cementing.

The thickness of the insert and the length of the stud or projection are so selected that in the folded or closed position of each side leg, the end face of the insert will be level with the outer end face of the stud or projection.

In a second form, the insert has a thickness less than the wall thickness of the corresponding side leg and is held in a groove or recess made in the thickness of the wall of the leg by a removable cylindrical cover or retainer, the end wall of which has a central opening, and is located on a level with the outer end face of the stud or projection in the closed position of the side leg.

It will be understood that thus, according to the invention there is caused a latching or locking of each side leg on the central body by the engagement of the stud or projection on the central body, into the central opening of the insert, around which a deformable annular zone is created by the presence of the axially opening annular groove, made in the insert. The latching force is thus obtained by the flexion or deformation of this annular region in combination with the compression forces.

The insert according to the invention is preferably made in the form shape of a cylindrical lozenge or washer, the opening for the stud or projection being in the center.

This insert is made, for example, of a natural or synthetic elastomer or, of a composite material such as a resin loaded with fibers, especially carbon fibers.

In a second embodiment of the invention, the annular element with radial elasticity, for each side leg comprises an annular metal spring within a portion of the thickness of the wall of the corresponding side leg and retained with radial clearance or play, in a lodging or seat delimited within the thickness of the side leg by a removable cylindrical retainer the end wall of which has a central opening, and is located on a level with the end face of the corresponding stud or projection in the closed position of the side leg on the central body of the clasp.

The retention with play of the spring in its seat ensures a self-centering effect in this embodiment, and in addition, although a metal on metal contact is exerted during the latching engagement and disengagement of the stud from the annular spring, the wear is very small due to the fact that the rubbing is spread over the entire periphery of the stud. This spring can be a circle of spring wire with the facing ends unconnected.

The studs or projections according to the invention can be fastened by any appropriate means on the central body of the clasp, especially by being riveted to the body. Thus it will be understood that there is, on the body part of the clasp in contact with the skin, no opening or cut-out to allow the passage of perspiration or dirt and other pollutants.

In order to make the invention better understood, one embodiment will now be described as a totally non-limiting example with reference to the accompanying drawings.

DETAILED DESCRIPTION

Figure 1:
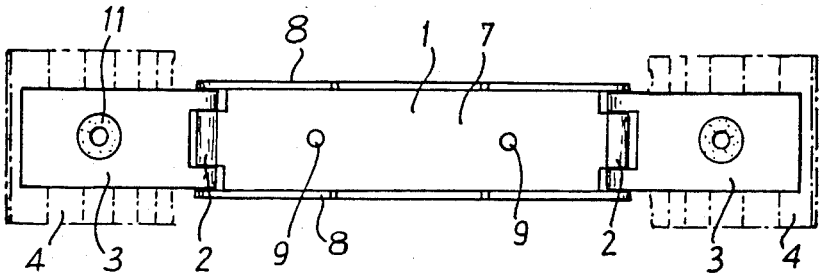
FIG. 1 is a somewhat schematic top plan view of a clasp according to a first embodiment of the invention, with the clasp open.

The clasp according to the invention includes a central body 1 at the ends of which two shorter side parts or legs 3 are hinged or pivoted at pivots 2. The metal band or bracelet is secured to the respective legs 3 by appropriate means, especially screws, soldering or welding.

Since the characteristics of the metal band or bracelet are not part of the present invention, this bracelet is only shown schematically in the drawings.

The ends of the two bracelet parts 4 can be straight and continuous, or preferably can be constituted of mutually displaced and interfingered end links to give an appearance of a continuous bracelet or band in the region of the middle portion of central body 1 of the clasp, when the clasp is closed.

The central body, of the clasp is comprised of a base plate 5 which is relatively thin and is curved in the usual way, to correspond to the curvature of the wrist of the wearer.

This base plate 5 has an inner surface 6 which engages the wrist and an outer surface 7, which faces outwardly away from the wrist.

Body 1 also has longitudinal extending sides or flanges 8 generally formed by bending from the base plate 5, and which project outwardly away from the wrist and beyond the outer surface 7 of the base plate.

Two studs or projections 9, which can be of metal project outwardly from surface 7 of base plate 5 of body 1 of the clasp. These studs or projections 9 are made, for example, of a metal alloy such as stainless steel. Studs 9, as can best be seen at FIG. 3, are fastened, to base plate 5, by riveting or staking the inner end of a stud in an opening in base plate 5.

Figure 3:
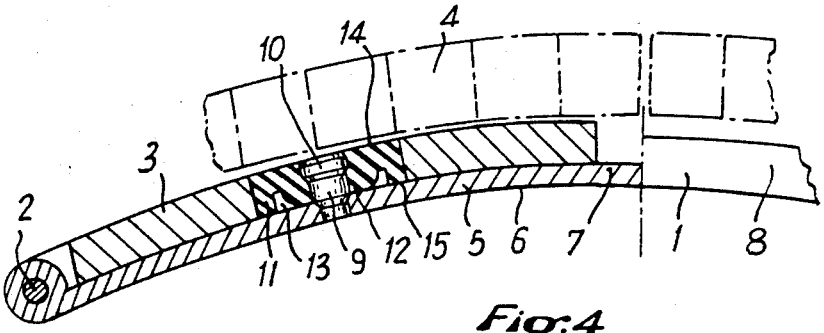
FIG. 3 is an enlarged partial side view in elevation and partial section of the clasp of FIGS. 1 and 2, showing the clasp in a closed position.
Figure 4:
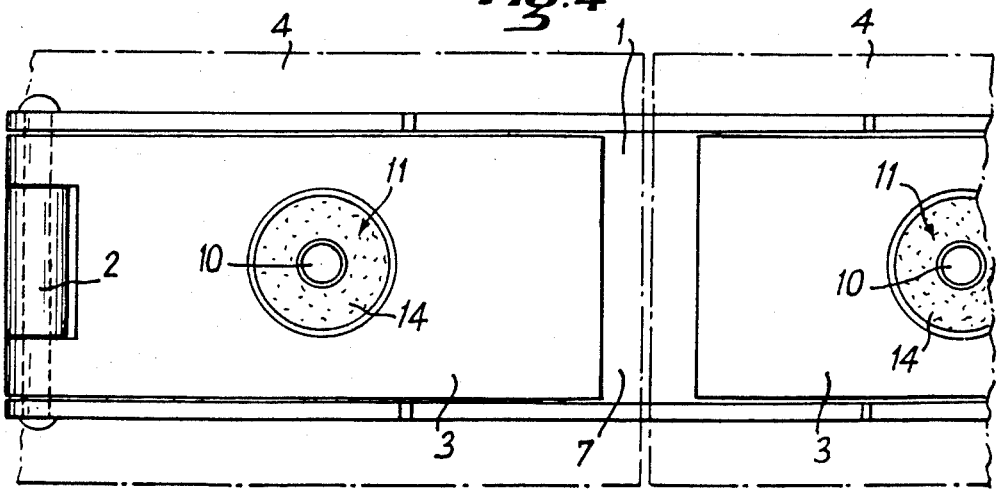
FIG. 4 is an enlarged top view of the clasp closed, and with the bracelet or band shown in phantom lines.

As may be seen at FIG. 3, the inner face 6 of base plate 5, which contacts the wrist, is continuous and has no opening or cut-out once stud 9 is put in place. Stud 9 has a body, in the form of a cylindrical shank, ending at its outer end in a head 10 of larger diameter which is chamferred at its outer end and at its junction with the shank. The inner end of the stud can be of reduced diameter so that a shoulder is provided for seating in the body.

In the thickness of the wall of each of the side legs 3, which are curved to correspond to body 1, is placed, in the first embodiment, an insert 11 in the form of a lozenge or washer of elastomer or a composite material, each insert 11, as can best be seen at FIG. 3, having a central opening 12, and an annular recess 13 spaced radially outwardly of the central opening 12 and extending only a part of the height of the insert.

Opening 12 extends through the entire thickness of insert 11 and has in the vicinity of outer end face 14 which is at the opposite end of the insert from the face 15 in which the annular groove 13 is made, an opening of a section of larger diameter to receive the enlarged head 10 of stud 9.

In the example shown, insert 11 extends over the entire height of the thickness of the wall of leg 3, being retained by any appropriate means such as cementing or threading in a cavity or opening of corresponding shape in body 3. Where the insert is retained by threading, the opening in leg 3 can have threads which coact with threads on the perimeter of the insert. The insert can also be retained in the leg by an inwardly projecting flange in the leg opening and a cooperating radial recess in the perimeter of the insert.

It will be understood that the inserts according to the invention can easily be replaced in the case of deterioration or wear, without the need to disassemble the clasp.

Figure 2:
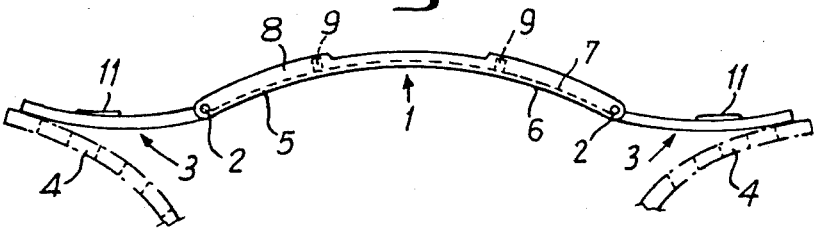
FIG. 2 is a side view in elevation of the clasp of FIG. 1.

To reach the locking or closed position shown at FIG. 3, starting from the open position shown at FIGS. 1 and 2, each of the side legs 3 is pivoted around its pivot 2 on central body 1, so that each of the studs 9 engages in the corresponding opening 12 of the respective inserts 11, elastically pushing back and deforming during its advance, the annular region between opening 12 and groove 13, until it reaches the final or seated position of FIG. 3 in which the end face of head 10 of the stud is level with the outer end face 14 of the insert.

To unlock the clasp, pressure is exerted outwardly on legs 3 of the clasp, or on bracelet parts 4, which are fastened to the legs, to withdraw and disengage studs 9 from inserts 11 until the clasp is entirely open, by pivoting legs 3 outwardly around pivots 2 on the central body 1.

Figure 5:
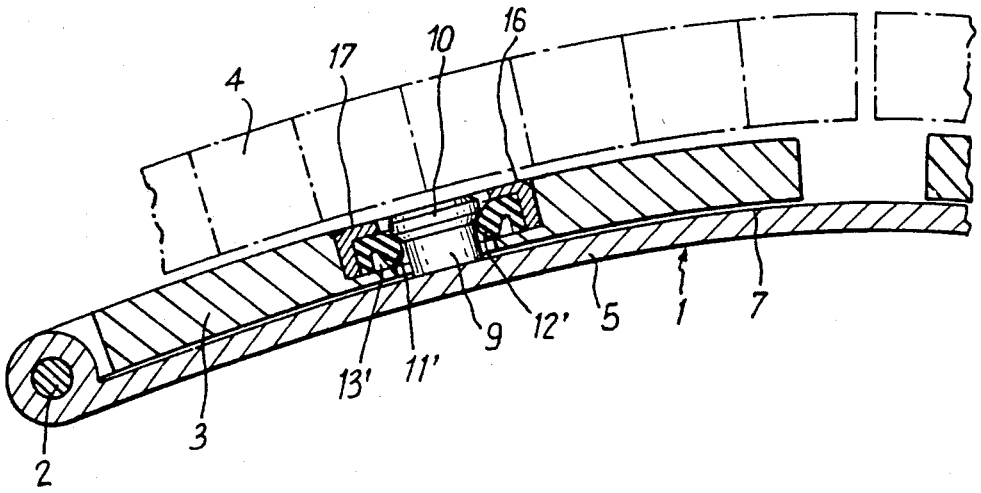
FIG. 5 is an enlarged view similar to FIG. 3, but of a second form of the first embodiment of the clasp according to the invention.

The variation of the embodiment shown at FIG. 5 differs from the embodiment of the FIGS. 1 to 4 only in the structure of the locking parts on the side legs 3 of the clasp, the corresponding locking means i.e. the studs 9, on the central body being the same.

In this variation, insert 11', as in the preceding example, has a central opening 12' and an annular groove 13', but is of a thickness less than the wall thickness of leg 3. This insert 11' is held in a corresponding cavity delimited by an inner wall of leg 3 and by a cylindrical cover or retainer 16, the outer surface 17 of which is level or flush with the outer surface of the side leg 3, and also with the outer end face of the head 10 of stud 9, when this stud is engaged in central opening 12' of insert 11'.

The operation of the clasp in this variation is of course identical to that described above.

Figure 6:
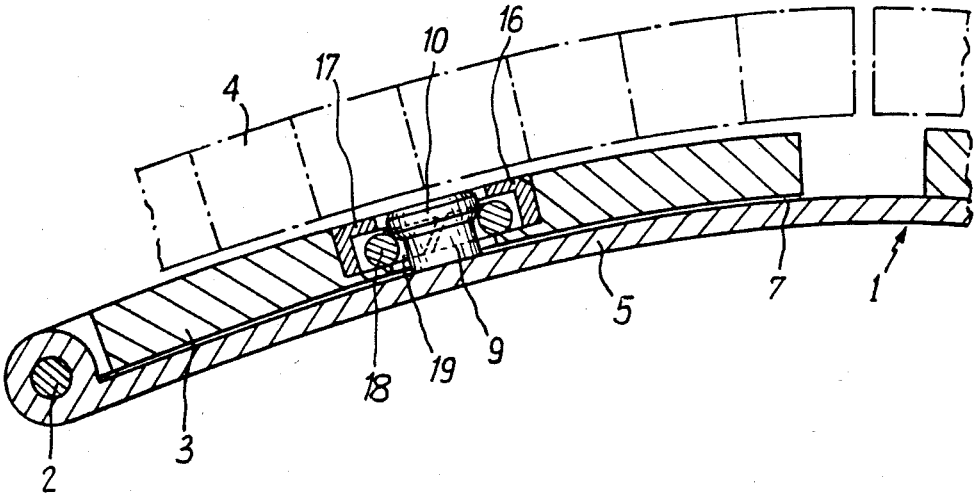
FIG. 6 is a view similar to FIG. 5 of a second embodiment of the clasp according to the invention.

In the embodiment of FIG. 6, as in the variation of FIG. 5, there is a cylindrical cover or retainer 16 having an outer wall 17, insert 11' being in this embodiment replaced by an annular metal spring 18 delimiting a central opening 19 and mounted, as can be seen at FIG. 6, with radial clearance or play in the cavity in the wall of side leg 3, and delimited by a lower or inner wall of leg 3 and a cover 16.

As shown at FIG. 6, the spring 18 takes the form of a length of spring wire bent into a circle and the facing ends of which are parallel, but at an angle to the axis of the ring. This split in the ring enables the ring to expand as the clasp is closed, so that the head 10 of stud 9 can pass through the ring, whereupon the ring contracts under the head to maintain the clasp closed.

The operation of this second embodiment is also identical to that described for the first embodiment, to open and close the clasp.

Although the invention has been described in connection with particular embodiments, it is in no way thereby limited and numerous variations can be made, especially as to the form and the materials used without exceeding either its scope or its spirit.

I claim:

1. A clasp for a bracelet, especially for a wrist-watch, said clasp being hidden and comprising, a central body having an outer surface, a rigid unitary side leg hinged to each end of the central body, said legs being of a predetermined thickness between inner and outer surfaces thereof and having a combined length less than the length of the central body, each leg being pivotal between an open position away from the central body and a closed postion on the central body in which the inner surface of each leg is closely adjacent to the outer surface of the central body, each of the side legs having means for fastening to a bracelet element, cooperating locking means on said legs and on said body for retaining said legs in a closed and latched position on said body, said locking means on said body comprising, studs having inner ends connected to the central body of the clasp and projecting outwardly from an outer face of the central body, said studs each having a head at an outer end thereof of larger section than a shank section thereof, said locking means on said legs comprising, an annular radially elastic element having a central opening therein and seated and retained in the thickness of the wall of each of said legs, each elastic element having a thickness not greater than the thickness of the leg so that the locking means on the legs are each contained within the thickness of the legs between the inner and outer surfaces thereof, each of the said studs being positioned on the body to engage and be forced through the opening of the respective annular radially elastic elements in the legs, when said side legs of the clasp are pivoted to said closed position on the body, said studs each being of a length to be contained within the thickness of the leg and not project beyond the outer surface thereof, in said closed position of the legs on said body.

2. A clasp according to claim 1, wherein each of the radially elastic elements comprises, a non-metal insert seated in a corresponding cavity in the wall of each of the side legs, each of the inserts having an annular groove concentric with the central opening of the radially elastic element and being outwardly of and of a diameter greater than the central opening, said groove having a height less that the height of the insert and opening through a surface of the insert which faces toward the outer surface of the body, when the legs are in the closed and latched position on the outer surface of the body, to enhance the resiliency of said central opening.

3. A clasp according to claim 2, wherein said radially elastic element is of a thickness essentially the same as the entire wall thickness of the leg and is retained in an opening of corresponding form in the body.

4. A clasp according to claim 3, wherein the thickness of the insert and the length of the stud are each not greater than the thickness of a leg, so that an outer end face of the stud is level with an outer surface of the insert in which said stud engages.

5. A clasp according to claim 2, wherein the insert has a thickness less than the thickness of the side leg in which the insert is retained, and said insert is retained in a seat in the wall of the leg by a removable cylindrical retainer having an outer wall with a central opening, and flush with the outer end surface of the stud in the closed position of the side leg on the central body of the clasp.

6. A clamp for a bracelet, especially for a wrist-watch, said clasp being hidden and comprising, a central body having an outer surface, a rigid unitary side leg hinged to each end of the central body, said legs being of a predetermined thickness between inner and outer surfaces thereof and having a combined length less than the length of the central body, each leg being pivotal between an open position away from the central body and a closed position on the central body in which the inner surface of each leg is closely adjacent to the outer surface of the central body, each of the side legs having means for fastening to a bracelet element, cooperating locking means on said legs and on said body for retaining said legs in a closed and latched position on said body, said locking means on said body comprising, studs having inner ends connected to the central body of the clasp and projecting outwardly from an outer face of the central body, said studs each having a head at an outer end thereof of larger section than a shank section thereof, said locking means on said legs comprising, an annular radially elastic element having a central opening therein and seated and retained in the thickness of the wall of each of said legs, each elastic element having a thickness not greater than the thickness of the leg so that the locking means on the legs are each contained within the thickness of the legs between the inner and outer surfaces thereof, each of the said studs being positioned on the body to engage and be forced through the opening of the respective annular radially elastic elements in the legs, when said side legs of the clasp are pivoted to said closed position on the body, and wherein each of the radially elastic elements comprises, a non-metal insert seated in a corresponding cavity in the wall of each of the side legs, each of the inserts having an annular groove concentric with the central opening of the radially elastic element and being outwardly of and of a diameter greater than the central opening, said groove having a height less than the height of the insert and opening through a surface of the insert which faces toward the outer surface of the body, when the legs are in the closed and latched position on the outer surface of the body, to enhance the resiliency of said central opening.

* * * * *